US009861213B2

(12) United States Patent
Goch et al.

(10) Patent No.: US 9,861,213 B2
(45) Date of Patent: Jan. 9, 2018

(54) FORCED COLD AIR WELL WITH FALSE BOTTOM INSERT

(71) Applicant: The Vollrath Company, L.L.C., Sheboygan, WI (US)

(72) Inventors: Bernard J. Goch, Elkhart Lake, WI (US); Kathleen A. Wollenberg, Waldo, WI (US)

(73) Assignee: The Vollrath Company, L.L.C., Sheboygan, WI (US)

( * ) Notice: Subject to any disclaimer, the term of this patent is extended or adjusted under 35 U.S.C. 154(b) by 275 days.

(21) Appl. No.: 14/540,566

(22) Filed: Nov. 13, 2014

(65) Prior Publication Data

US 2016/0135615 A1 May 19, 2016

(51) Int. Cl.
*A47F 3/04* (2006.01)

(52) U.S. Cl.
CPC ..... *A47F 3/0447* (2013.01); *A47F 3/0452* (2013.01)

(58) Field of Classification Search
CPC ..... A47F 3/0447; A47F 3/0452
See application file for complete search history.

(56) References Cited

U.S. PATENT DOCUMENTS 2,608,831 A * 9/1952 Steelman ..... A47F 3/0447 165/223
2,693,089 A 11/1954 Teeter
2,967,404 A 1/1961 Detwiler
3,543,532 A 12/1970 Gatton et al.
3,696,630 A 10/1972 Bressickello
3,780,794 A 12/1973 Staub
4,019,339 A * 4/1977 Anderson ..... A47F 3/0443 62/255
4,106,305 A 8/1978 Ibrahim
(Continued)

FOREIGN PATENT DOCUMENTS

CA 2387771 11/2003
DE 19635265 A1 * 3/1998 ..... A47F 3/0447
(Continued)

OTHER PUBLICATIONS

Aladdin Temp-Rite J713 Series Slim Line Cold Food Counters product information sheet, Aladdin Temp-Rite, retrieved from the internet at: http://aladdintemprite.com/counter-cold-food-slim-line.html on Jan. 27, 2015, 2 pages.
(Continued)

*Primary Examiner* — Emmanuel Duke
(74) *Attorney, Agent, or Firm* — Foley & Lardner LLP

(57) ABSTRACT

A cold food display unit includes a well defining a receptacle, an insert positioned within the receptacle, a refrigeration system, a first cooling air discharge, and a second cooling air discharge. The insert is positioned within the receptacle to form a first cooling air flow path and a second cooling air flow path. The refrigeration system includes a cooling air outlet positioned within the receptacle to provide cooling air to the first and second cooling air flow paths. The first cooling air discharge discharges a first flow of cooling air toward the second side of the well, and the second cooling air discharge discharges a second flow of cooling air toward the first side of the well.

23 Claims, 14 Drawing Sheets

(56) References Cited

U.S. PATENT DOCUMENTS

| | | | | | |
|---|---|---|---|---|---|
| 4,182,130 | A * | 1/1980 | Ljung | A47F 3/0443 | 62/256 |
| 4,337,626 | A | 7/1982 | Ibrahim | | |
| 4,439,992 | A | 4/1984 | Ibrahim | | |
| 4,449,374 | A | 5/1984 | Ibrahim | | |
| 4,457,140 | A | 7/1984 | Rastelli | | |
| 4,628,697 | A | 12/1986 | Bruck et al. | | |
| 4,723,414 | A | 2/1988 | Hurutachi et al. | | |
| 4,802,340 | A * | 2/1989 | Johnson | A47F 3/0452 | 62/229 |
| 4,840,040 | A * | 6/1989 | Fung | A47F 3/0447 | 454/190 |
| 4,882,910 | A | 11/1989 | Meehan et al. | | |
| 5,117,649 | A | 6/1992 | Mangini et al. | | |
| 5,138,843 | A | 8/1992 | Tamayama et al. | | |
| 5,168,719 | A * | 12/1992 | Branz | A47F 3/0408 | 62/256 |
| 5,282,367 | A | 2/1994 | Moore et al. | | |
| 5,297,616 | A | 3/1994 | Pralus | | |
| 5,363,672 | A | 11/1994 | Moore et al. | | |
| 5,423,194 | A | 6/1995 | Senecal | | |
| 5,442,932 | A * | 8/1995 | O'Hearne | A47F 3/0447 | 62/255 |
| 5,477,702 | A | 12/1995 | Kennedy et al. | | |
| 5,590,541 | A * | 1/1997 | Rainwater | A47F 3/0408 | 62/255 |
| 5,775,124 | A | 7/1998 | Park et al. | | |
| 5,826,432 | A | 10/1998 | Ledbetter | | |
| 6,089,036 | A | 7/2000 | Carlson et al. | | |
| 6,109,051 | A | 8/2000 | Majordy | | |
| 6,151,905 | A | 11/2000 | Smith | | |
| 6,237,775 | B1 | 5/2001 | Hatch et al. | | |
| 6,385,990 | B1 * | 5/2002 | Lee | B21B 27/10 | 62/373 |
| 6,557,363 | B1 | 5/2003 | Haasis et al. | | |
| 6,612,124 | B1 | 9/2003 | Hatch et al. | | |
| 6,782,706 | B2 | 8/2004 | Holmes et al. | | |
| 6,799,433 | B1 | 10/2004 | Gleason et al. | | |
| 7,204,095 | B2 | 4/2007 | Jeong et al. | | |
| 7,243,506 | B2 | 7/2007 | Spillner | | |
| 7,322,204 | B2 * | 1/2008 | Hirao | A47F 3/0439 | 62/255 |
| 8,739,495 | B1 | 6/2014 | Witherspoon | | |
| 8,794,021 | B2 | 8/2014 | Hahn et al. | | |
| 2004/0115334 | A1 | 6/2004 | Romero Olmedo | | |
| 2005/0086965 | A1 * | 4/2005 | Lalumiere | F25B 39/022 | 62/277 |
| 2006/0144070 | A1 | 7/2006 | Perthold et al. | | |
| 2006/0201177 | A1 * | 9/2006 | Spillner | A47F 3/0447 | 62/258 |
| 2007/0130979 | A1 * | 6/2007 | Norrby | A47F 3/0443 | 62/255 |
| 2008/0202491 | A1 | 8/2008 | Eberhard | | |
| 2008/0236182 | A1 | 10/2008 | Hahn et al. | | |

FOREIGN PATENT DOCUMENTS

| | | | | |
|---|---|---|---|---|
| EP | 0 957 732 | | 8/2002 | |
| EP | 1 407 700 | | 4/2004 | |
| EP | 1 424 901 | | 6/2004 | |
| EP | 2 374 377 | A1 | 12/2011 | |
| FR | 2230159 | | 12/1974 | |
| FR | 2383634 | | 10/1978 | |
| FR | 2711309 | B1 | 12/1995 | |
| FR | 2818521 | B1 | 9/2003 | |
| GB | 0 914 902 | A | 1/1963 | |
| GB | 2 075 165 | A | 11/1981 | |
| GB | 2 091 402 | | 10/1984 | |
| GB | 2 247 068 | A | 2/1992 | |
| GB | 2 256 266 | A | 2/1992 | |
| WO | WO-93/13371 | | 8/1993 | |
| WO | WO-03/015524 | | 2/2003 | |
| WO | WO-03/073028 | | 9/2003 | |
| WO | WO 2006087009 | A1 * | 8/2006 | A47F 3/0447 |
| WO | WO-2012/145136 | A1 | 10/2012 | |

OTHER PUBLICATIONS

Beverage-Air Food Preparation Series Prep Tables SPE60 Elite Series Mega Top with See-Thru Glass Lid, model specification sheet, Beverage-Air Corporation, Nov. 2013, 2 pages.

Delfield 19600PTBM Self-Contained Refrigerated Pizza Prep Tables, Oct. 2010, retrieved from the internet at: http://images.centralrestaurant.com/images/assets/specsheets/565-098.pdf on Jan. 27, 2015, 4 pages.

Delfield N8100-FA Drop-in Self-Contained Forced Air Refrigerated Cold Pans, model specification sheet, Dec. 2013, 2 pages.

Dinex DXDVLHF2 Product Information Page, Restaurant Equipment World, retrieved from the internet at: http://www.rewonline.com/restaurant-equipment-new/Dinex-DXDVLHF2-Serving-Counter-Hot-Food-Steam-Table-Electric/DIN-DXDVLHF2.html on Jan. 27, 2015, 2 pages.

Dual Cool Pizza Prep Tables, McCall Refrigeration, Oct. 2003, retrieved from the internet at: http://www.ckitchen.com/SpecSheet/McCall/PTA-3.pdf on Jan. 27, 2015, 2 pages.

Food and Beverage Service, B.Sc. First Year, Part III, Paper 2, 2008, Bharathiar University, 179 pages.

Food Safety Fact Sheet—Holding Cold Foods, National Food Service Management Institute, The University of Mississippi, 2008, 2 pages.

Food-Prep Tables, Beverage-Air, 2008, retrieved from the internet at: http://www.beverage-air.com/Main.aspx?pid=43&tab=44 on Jan. 27, 2015, 1 page.

Holding Hot and Cold Potentially Hazardous Foods, United States Department of Agriculture, retrieved from the internet at: http://sop.nfsmi.org/HACCPBasedSOPs/HoldingHotandColdPHF.pdf on Jan. 27, 2015, 3 pages.

Owners Manual for 9000K-7 Series High Volume Saladtop Refrigerators, Randell Manufacturing, Inc., Jun. 8, 2001, 21 pages.

Randell Cold Food Tables, retrieved from the internet at: http://www.wasserstrom.com/restaurant-supplies-equipment/cooking_coldfoodtable_1000148 on Jan. 27, 2015, 7 pages.

Randell Prep Tables Product Lineup, Unified Brands, retrieved from the internet at: http://www.unifiedbrands.net/products/randell/prep-tables/ on Jan. 27, 2015, 11 pages.

Randell Price Book (effective Aug. 1, 2011), Unified Brands, Jul. 2011, retrieved from the internet at: http://www.greenfieldworld.com/pricelist/Randell%20Price%20Book%20August%202011.pdf on Jan. 27, 2015, 84 pages.

ThermalRite Blast Chiller and Shock Freezer Systems, ThermalRite, 2014, retrieved from the internet at: http://www.thermalrite.com/wp-content/uploads/2012/05/p140217-1_thermalrite-brochure_4-2d2014.pdf on Jan. 27, 2015, 12 pages.

* cited by examiner

FORCED COLD AIR WELL WITH FALSE BOTTOM INSERT

BACKGROUND

The present invention relates generally to the field of food displays and serving equipment and in particular to the field of forced cold air wells.

Conventional forced cold air wells support one or more food pans. Conventional forced cold air wells may undesirably freeze or dry the food displayed within the food pan. Many conventional forced cold air wells blow cold air directly onto one or more surfaces of the food pan, which may cause the undesirable freezing or drying of the food displayed within the food pan. Many conventional forced cold air wells blow cold air over the food pan in a single direction with a cold air return inlet positioned opposite a cold air discharge. However, the cold air return inlet in practice functions primarily as an ambient air inlet and not a cold air return because the cold air provided from the cold air discharge does not travel the full distance across the food pan to the cold air return inlet. This distance is typically the length of an industry standard full-size food pan, which is about twenty-one inches.

SUMMARY

One embodiment of the invention relates to a cold food display unit including a well defining a receptacle, wherein the well includes a first side and a second side opposite the first side, an insert positioned within the receptacle, wherein the insert includes a bottom, a first insert side, and a second insert side, wherein the first insert side extends away from the bottom from a first end of the bottom and the second insert side extends away from the bottom at a second end of the bottom opposite the first end, wherein the first insert side is positioned near the first side of the well to form a first cooling air flow path, and wherein the second insert side is positioned near the second side of the well to form a second cooling air flow path, a refrigeration system including an evaporator positioned within a housing, wherein the housing is positioned within the receptacle below the bottom of the insert, wherein a cooling air outlet is formed in the housing, and wherein a fan is located within the housing and is configured to blow air across the evaporator, thereby providing cooling air at a positive static pressure to the first and second cooling air flow paths via the cooling air outlet, a first cooling air discharge fluidly coupled to the first cooling air flow path, wherein the first cooling air discharge is configured to discharge a first flow of cooling air toward the second side of the well, a second cooling air discharge fluidly coupled to the second cooling air flow path, wherein the second cooling air discharge is configured to discharge a second flow of cooling air toward the first side of the well, a ledge configured to support one or more food pans, wherein the first cooling air discharge, the second cooling air discharge are located above the ledge, and an ambient air intake, wherein the ambient air intake is fluidly coupled to the housing of the refrigeration system to provide ambient air to be cooled by the evaporator.

Another embodiment of the invention relates to cold food display unit including a well defining a receptacle, wherein the well includes a first side and a second side opposite the first side, an insert positioned within the receptacle to form a first cooling air flow path between the insert and the first side of the well and to form a second cooling air flow path between the insert and the second side of the well, a refrigeration system including a cooling air outlet, wherein the cooling air outlet is positioned within the receptacle to provide cooling air to the first and second cooling air flow paths, a first cooling air discharge fluidly coupled to the first cooling air flow path, wherein the first cooling air discharge discharges a first flow of cooling air toward the second side of the well, and a second cooling air discharge fluidly coupled to the second cooling air flow path, wherein the second cooling air discharge discharges a second flow of cooling air toward the first side of the well.

Another embodiment of the invention relates to a method of cooling a food pan which includes supporting a food pan, cooling air with a refrigeration system, providing cooling air from the refrigeration system to a plenum at a positive static pressure, wherein the plenum is located below the food pan, providing an insert between the plenum and the food pan to prevent the cooling air from flowing directly from the plenum to the food pan, directing a first flow of cooling air from the plenum to a first cooling air discharge that discharges the first flow of cooling air in a first direction over the food pan, and directing a second flow of cooling air from the plenum to a second cooling air discharge that discharges the second flow of cooling air in a second direction over the food pan, wherein the second direction is opposite the first direction.

Alternative exemplary embodiments relate to other features and combinations of features as may be generally recited in the claims.

BRIEF DESCRIPTION OF THE DRAWINGS

The invention will become more fully understood from the following detailed description, taken in conjunction with the accompanying drawings, in which.

DETAILED DESCRIPTION

Figure 1:
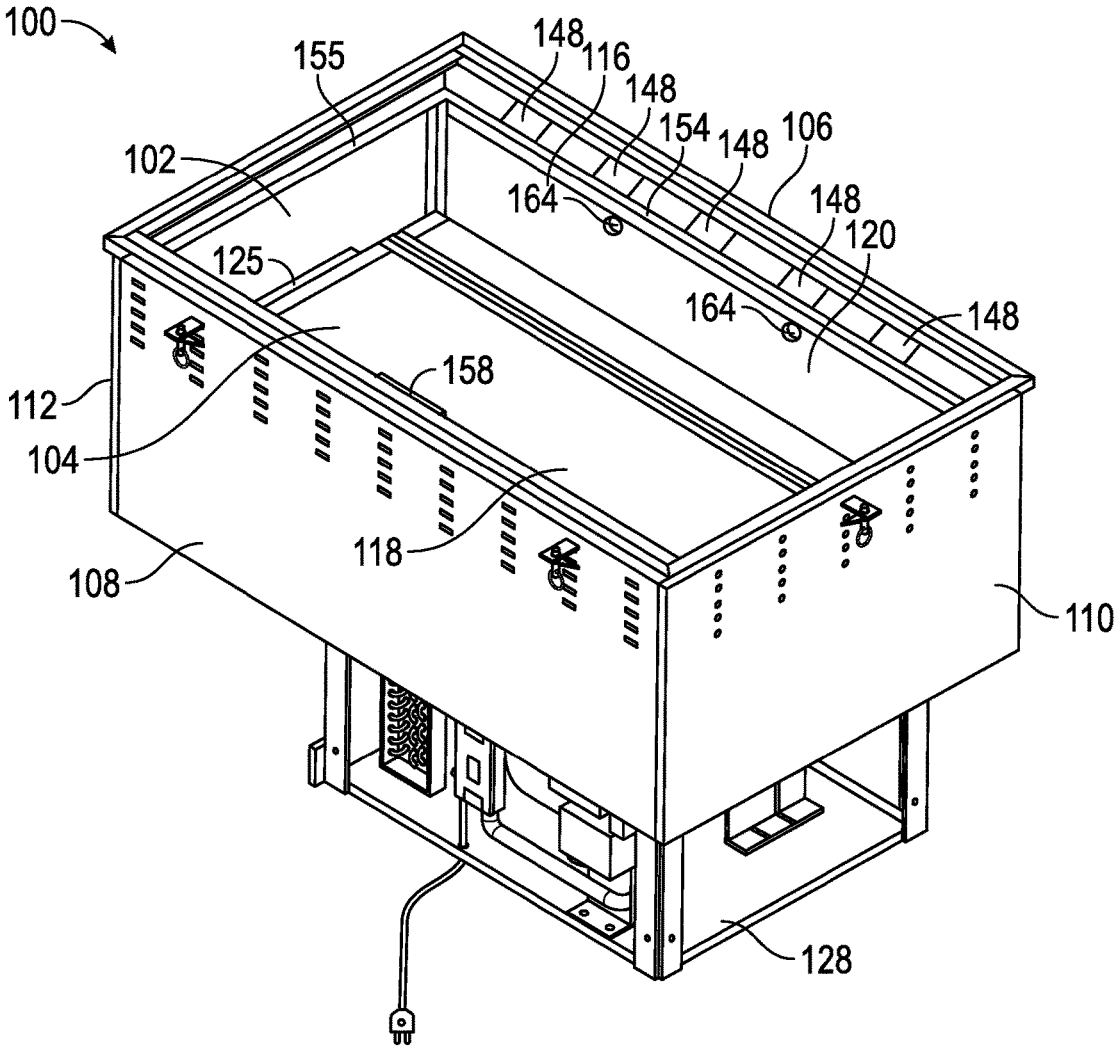
FIG. 1 is a perspective view of a cold food display unit according to an exemplary embodiment.
Figure 2:
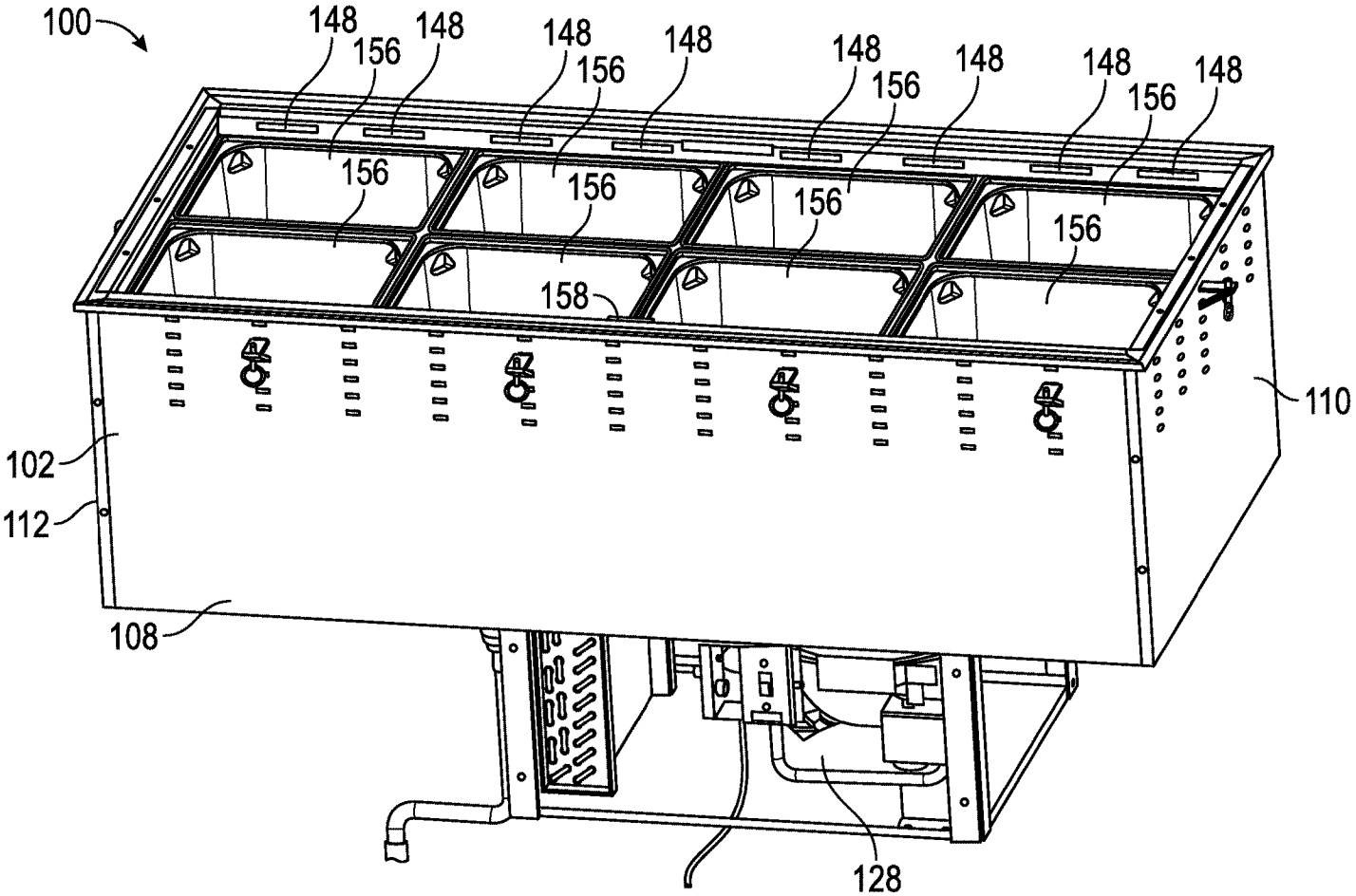
FIG. 2 is another perspective view of the cold food display unit of FIG. 1.

Before turning to the figures, which illustrate the exemplary embodiments in detail, it should be understood that the application is not limited to the details or methodology set forth in the description or illustrated in the figures. It should also be understood that the terminology is for the purpose of description only and should not be regarded as limiting.

The cold food display units described below improve upon conventional forced cold air wells in several ways. In some embodiments, the cold food display units include a false bottom insert that separates the food pan from the cooling air supply. This prevents the cooling air from blowing directly onto one or more food pan surfaces and significantly reduces the likelihood that food displayed in the food pan will freeze. The insert tempers the chilling effect of the direct convection of conventional forced cold air wells by providing a physical block between the source of the cold air and the food pan. The insert also functions at least in part as a cold plate that is chilled by the cold air from the cold air source. This cold plate functionality helps to evenly distribute the cooling effects provided underneath the food pan. In some embodiments, the cold food display units provide at least two flows of cooling air over the top of the food pan with the flows directed toward one another in opposing directions. This helps address the problem of the cold air return inlet of a conventional forced cold air well that functions as an ambient air inlet rather than the intended cold air return. The discharges providing these flows of cooling air may be formed in the false bottom insert. Some embodiments may also include a single ambient air intake that may be located above the food pan that serves as the sole intended source of ambient air to be cooled for use as cooling air.

Referring to FIGS. 1-5, a cold food display unit 100 is illustrated according to an exemplary embodiment. Cold food display unit 100 includes a well 102. Some embodiments include multiple wells. Well 102 defines a receptacle 104 between the sides or walls of the well. In the illustrated embodiment, well 102 includes four sides 106, 108, 110, and 112 and a bottom 114.

Figure 5:
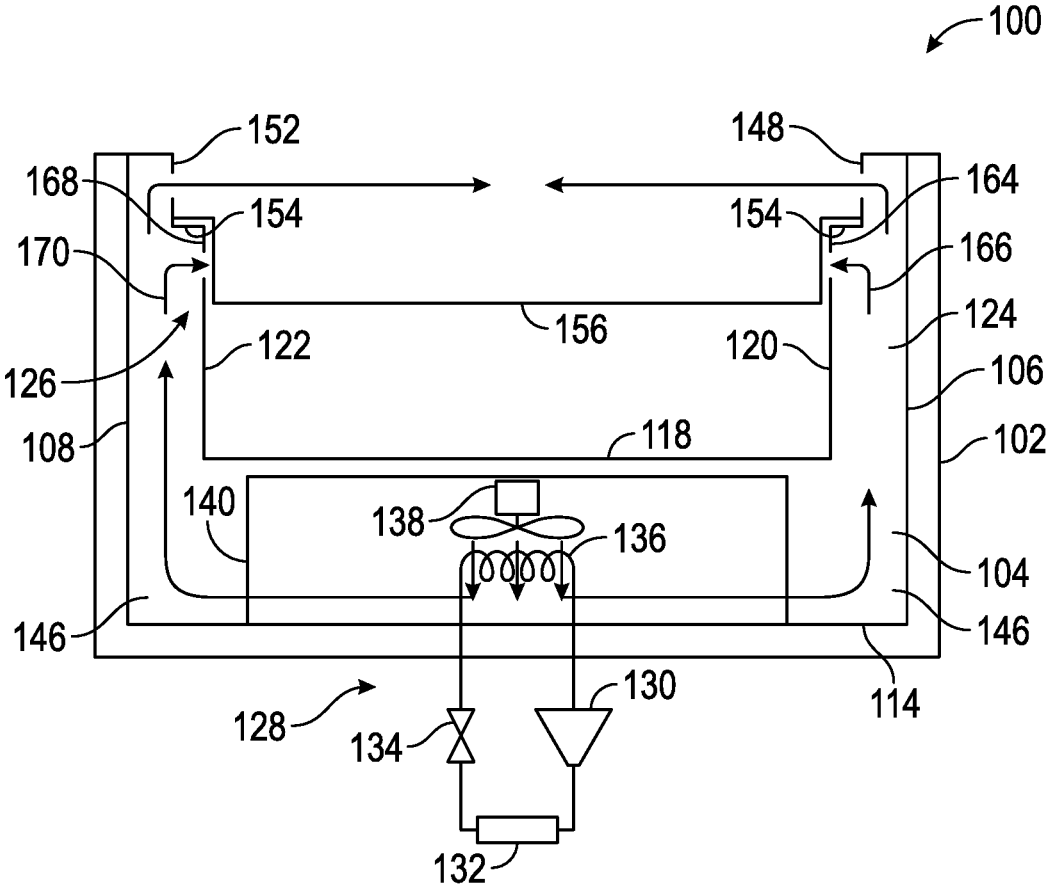
FIG. 5 is a schematic diagram of the cold food display unit of FIG. 1.

As shown in FIG. 5, an insert 116 (e.g., false bottom, shell, wall structure, wall insert, tray, channel, cold plate, floor, partition, barrier, divider, wall, heat sink, etc.) is positioned within receptacle 104. Insert 116 includes a bottom 118 and at least two sides 120 and 122. Side 120 extends upward away from bottom 118 from one end of bottom 118 and side 122 extends upward away from bottom 118 from the opposite side of bottom 118. Bottom 118 of insert 116 is spaced apart from bottom 114 of well 102. Side 120 of insert 116 is positioned near side 106 of well 102 (e.g., offset from the side of the well, spaced apart from the side of the well, separated from the side of the well, etc.) to form a first cooling air flow path 124. Side 122 of insert 116 is positioned near side 108 of well 102 (e.g., offset from the side of the well, spaced apart from the side of the well, separated from the side of the well, etc.) to form a second cooling air flow path 126. As shown in FIG. 1, ends 123 and 125 of insert 116 abut or engage sides 110 and 112 of well 102, respectively, so that well 102 and insert 116 are in contact along the perimeter of insert 116. Insert 116 may be coupled to well 102 in any appropriate manner. For example, insert 116 may be attached to well 102 by a bracket, fastener, or welding, insert 116 may include a flange that overhangs the top of well 102 to suspect insert within receptacle 104, or insert 116 may be supported by one or more legs extending between bottom 118 of inset 116 and bottom 114 of well 102. In some embodiments, insert 116 is formed from one or more pieces of sheet metal.

As shown in FIG. 5, cold food display unit 100 also includes a refrigeration system 128. Refrigeration system 128 includes a compressor 130, a condenser 132, an expansion valve 134, and an evaporator 136 for causing a refrigerant to cycle through a refrigeration cycle. A fan 138 blows air across evaporator 136 to provide cooling air for cold food display unit 100. In the illustrated embodiment, evaporator 136 and fan 138 are positioned within a housing 140. Housing 140 is positioned within receptacle 104 between bottom 114 of well 102 and bottom 118 of insert 116. Housing 140 includes at least one cooling air outlet 142 through which fan 138 blows cooling air. In the illustrated embodiment, housing 140 is spaced apart from sides 110 and 112 of well 102 and housing 140 includes two cooling air outlets 142 and 144 with cooling air outlet 142 facing side 110 of well 102 and cooling air outlet 144 facing side 112 of well 102. More or less outlets may be used to provide a particular desired cooling or air flow. Fan 138 provides cooling air to a plenum 146 formed between well 102, bottom 118 of insert 116, and housing 140. Plenum 146 is fluidly coupled to cooling air flow paths 124 and 126 so that chilled/cooling air is stored and provided at a positive static pressure to cooling air flow paths 124 and 126. The bottom 118 of the insert 116 is cooled by the chilled/cooled air in the plenum 146 (e.g., by the absorption of heat from the air space between the pan 156 and the insert 116 and/or the pan 156), which results in chilling of the air space and the pan 156 (e.g., serving as a cold plate, heat sink, etc.). The plenum 146 is located between the cooling air outlet and the first and second cooling air flow paths 124, 126, such that the fan 138 in the refrigeration system 128 provides cooling air to the plenum 146 that generates a positive static pressure within the plenum 146 and the first and second cooling air flow paths 124, 126. The static pressure within plenum 146 and the first and second cooling air flow paths 124, 126 provide a substantially even distribution of cooling air to the plurality of air discharge outlets 152, 168.

Figure 3:
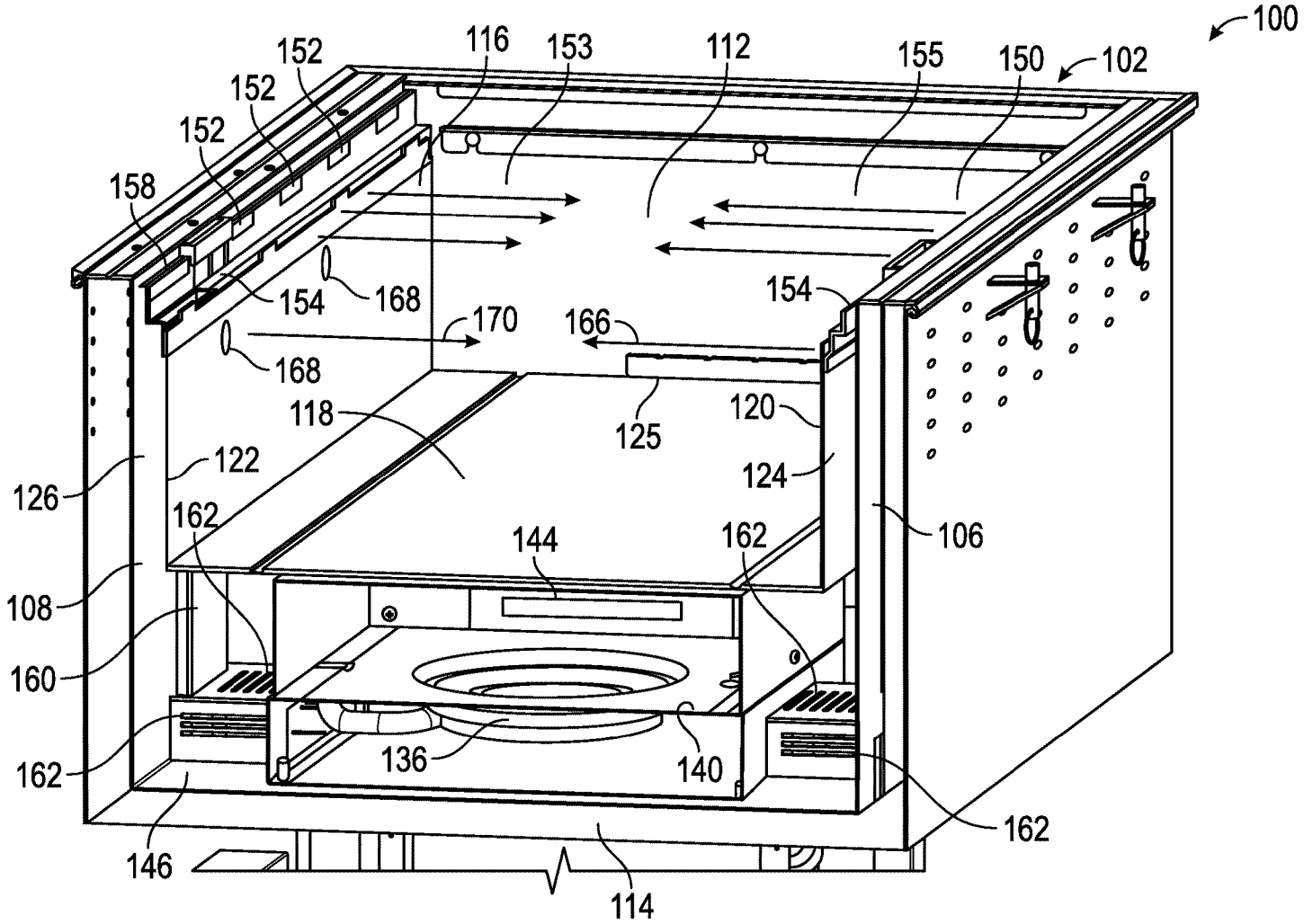
FIG. 3 is a perspective section view of the cold food display unit of FIG. 1.
Figure 4:
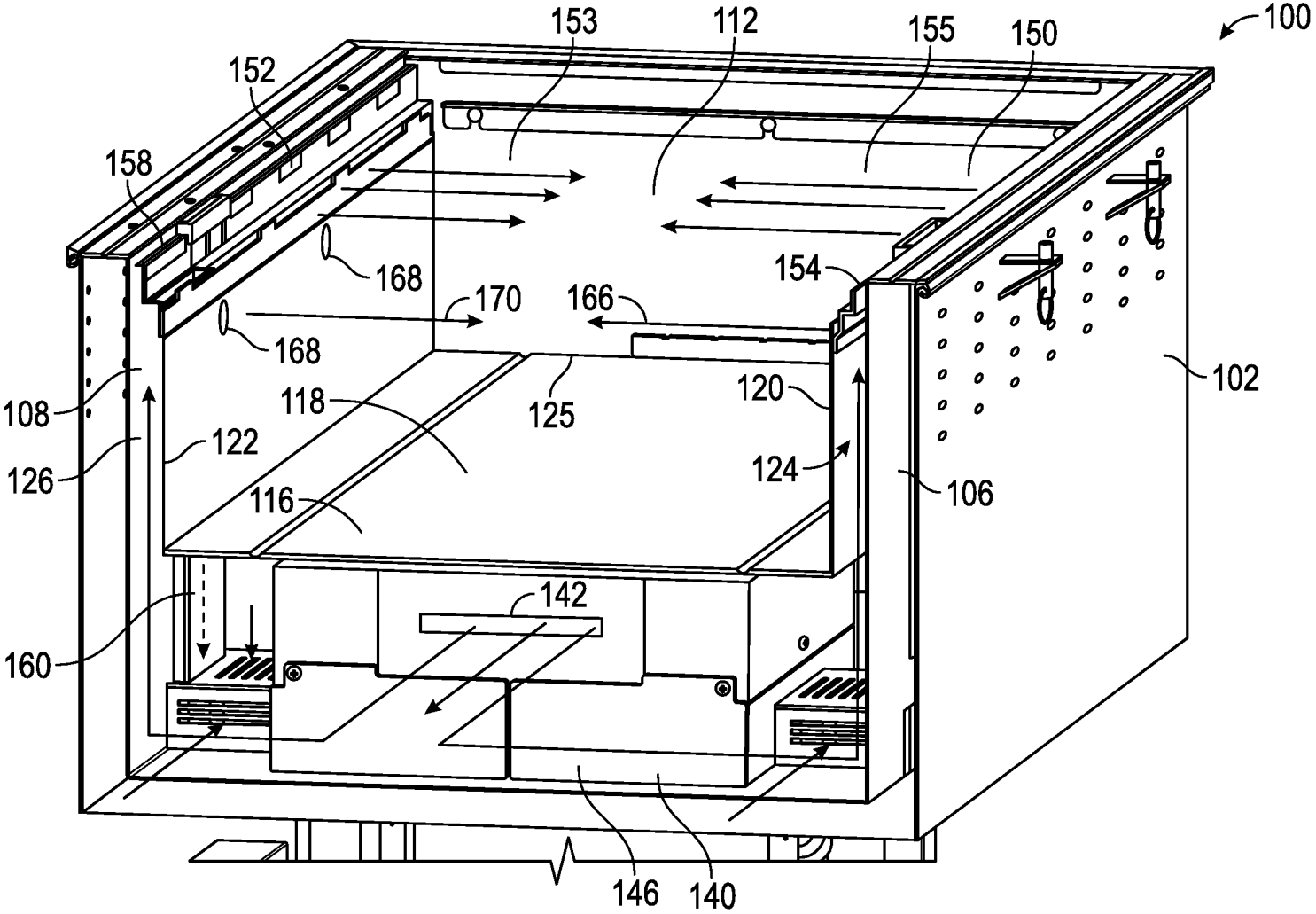
FIG. 4 is another perspective section view of the cold food display unit of FIG. 1.

As shown in FIGS. 3-5, a first cooling air discharge or outlet 148 is formed in side 106 of well 102 and generally above the top of the food pan 156. First cooling air discharge 148 may be a single vent, opening, or other aperture or a series of multiple individual vents, openings, or other apertures. First cooling air discharge 148 is fluidly coupled to first cooling air flow path 124 and discharges a first flow of cooling air 150 toward side 108 of well 102. A second cooling air discharge or outlet 152 is formed in side 108 of well 102. Second cooling air discharge 152 is similar to first cooling air discharge 148 and may be a single vent, opening, or other aperture or a series of multiple individual vents, openings, or other apertures. Second cooling air discharge 152 is fluidly coupled to second cooling air flow path 126 and discharges a second flow of cooling air 153 toward side 106 of well 102. This helps to provide relatively even cooling along the full distance between cooling air discharges 148 and 152. Discharges 148 and 152 may be configured to direct cooling air flows horizontally (i.e., substantially parallel to the top of food pan 156) or at an angle from horizontal (i.e., upward or downward toward the food displayed in food pan 156).

As shown in FIGS. 3-5, a ledge 154 is provided to support one or more food pans 156. In the illustrated embodiment, ledge 154 is formed in both sides 120 and 122 of insert 116. Alternatively, the ledge could be formed in two sides of the well. In the illustrated embodiment, an additional ledge 155 is attached to sides 110 and 112 of well 102. In the illustrated embodiment, cooling air discharges 148 and 152 are provided above ledge 154 so that the first flow of cooling air 150 and the second flow of cooling air 153 travel in opposite directions to one another above food pan 156 and any food displayed in food pan 156. This helps to provide relatively even cooling across food pan 156.

As shown in FIGS. 3-4, cold food display unit 100 also includes an ambient air intake 158 for providing ambient air to be cooled by evaporator 136. In the illustrated embodiment, ambient air intake 158 is formed in side 108 of well 102. In other embodiments, the ambient air intake may be formed in one of the other sides of the well. In other embodiments, the ambient air intake may be located underneath the well or at another appropriate location. Ambient air intake 158 may be a single vent, opening, or other aperture or a series of multiple individual vents, openings, or other apertures. In some embodiments, the area of ambient air intake 158 is less than the area of first cooling air discharge 148 and the area of ambient air intake is less than then areas of second cooling air discharge 152, providing a focused or discrete location for collecting ambient air to be cooled. In some embodiments, cold food display unit 100 includes multiple ambient air intakes.

As shown in FIGS. 3-4, an intake duct 160 is provided to fluidly couple the ambient atmosphere around cold food display unit 100 to the interior of housing 140. Ambient air intake 158 provides access to intake duct 160 for ambient air. In some embodiments, ambient air intake 158 is the sole intended source of ambient air to be cooled for use as cooling air. One or more internal air return intakes 162 may be formed in the portion of intake duct exposed to plenum 146 to allow internal return air within plenum 146 to mix with the ambient air being provided to the interior of housing 140 to be cooled for use as cooling air. In the illustrated embodiment, internal air return intakes 162 are positioned within receptacle 104.

As shown in FIGS. 3-5, in the illustrated embodiment, cold food display unit 100 also includes a first cooling air insert discharge 164 formed in side 120 of insert 116. First cooling air insert discharge 164 may be a single vent, opening, or other aperture or a series of multiple individual vents, openings, or other apertures. First cooling air insert discharge 164 is fluidly coupled to first cooling air flow path 124 and discharges a third flow of cooling air 166 toward side 122 of insert 116. First cooling air insert discharge 164 is positioned below ledge 154 so that third flow of cooling air 166 is directed at food pan 156 (i.e., an axis extending from first cooling air insert discharge 164 to show the direction of travel of third flow of cooling air 166 would intersect food pan 156).

As shown in FIGS. 3-5, in the illustrated embodiment, cold food display unit 100 also includes a second cooling air insert discharge 168 formed in side 122 of insert 116. Second cooling air insert discharge 168 may be a single vent, opening, or other aperture or a series of multiple individual vents, openings, or other apertures. Second cooling air insert discharge 168 is fluidly coupled to second cooling air flow path 126 and discharges a fourth flow of cooling air 170 toward side 120 of insert 116. Second cooling air insert discharge 168 is positioned below ledge 154 so that fourth flow of cooling air 170 is directed at food pan 156 (i.e., an axis extending from second cooling air insert discharge 168 to show the direction of travel of fourth flow of cooling air 170 would intersect food pan 156). It is believed that the relatively small size of cooling air insert discharges 164 and 168 and increases in cooling air temperature that occur while cooling air travels from housing 140 to discharges 164 and 168 help to prevent undesirable freezing of food displayed in food pan 156, even though discharges 164 and 168 directly cool food pan 156 in a manner that could be considered similar to the direct cooling provided by the conventional forced cold air wells lacking insert 116.

Providing cooling air a positive static pressure to cooling air flow paths 124 and 126 helps to ensure consistent cool air speeds from discharges 148, 152, 164, and 168. The positive static pressure helps to ensure that the cooling air speed provided from various similar discharges does not vary significantly based on the distance of the discharge from the cooling air supply (e.g., cooling air speed from the first cooling air discharges 148 does not vary significantly from discharge to discharge alongside 106).

FIGS. 3-5 use arrows to show the various flows of air through and around cold food display unit 100. During operation of cold food display unit 100, ambient air and internal return air are provide to the interior of housing 140 via ambient air intake 158, air return intakes 162, and intake duct 160. Fan 138 blows the mixed ambient air and internal return air across or over evaporator 136 to produce chilled/cooling air through the transfer of heat from the mixed intake air to the refrigerant in evaporator 136. Cooling air exits housing 140 to plenum 146 via cooling air outlet 142 and 144 at a positive static pressure. The positive static pressure causes cooling air to move from/through plenum 146 to/through cooling air flow paths 124 and 126 and exit cooling air flow paths 124 and 126 via cooling air discharges 148 and 152 as cooling air flows 150 and 153, respectively. First flow of cooling air 150 and second flow of cooling air 153 are directed over the top of food pan 156 in opposite directions. Additional cooling air exits cooling air flow paths 124 and 126 via cooling air insert discharges 164 and 168 as cooling air flows 166 and 170, respectively. Third flow of cooling air 166 and fourth flow of cooling air 170 are directed at food pan 156 in opposite directions.

Figure 6:
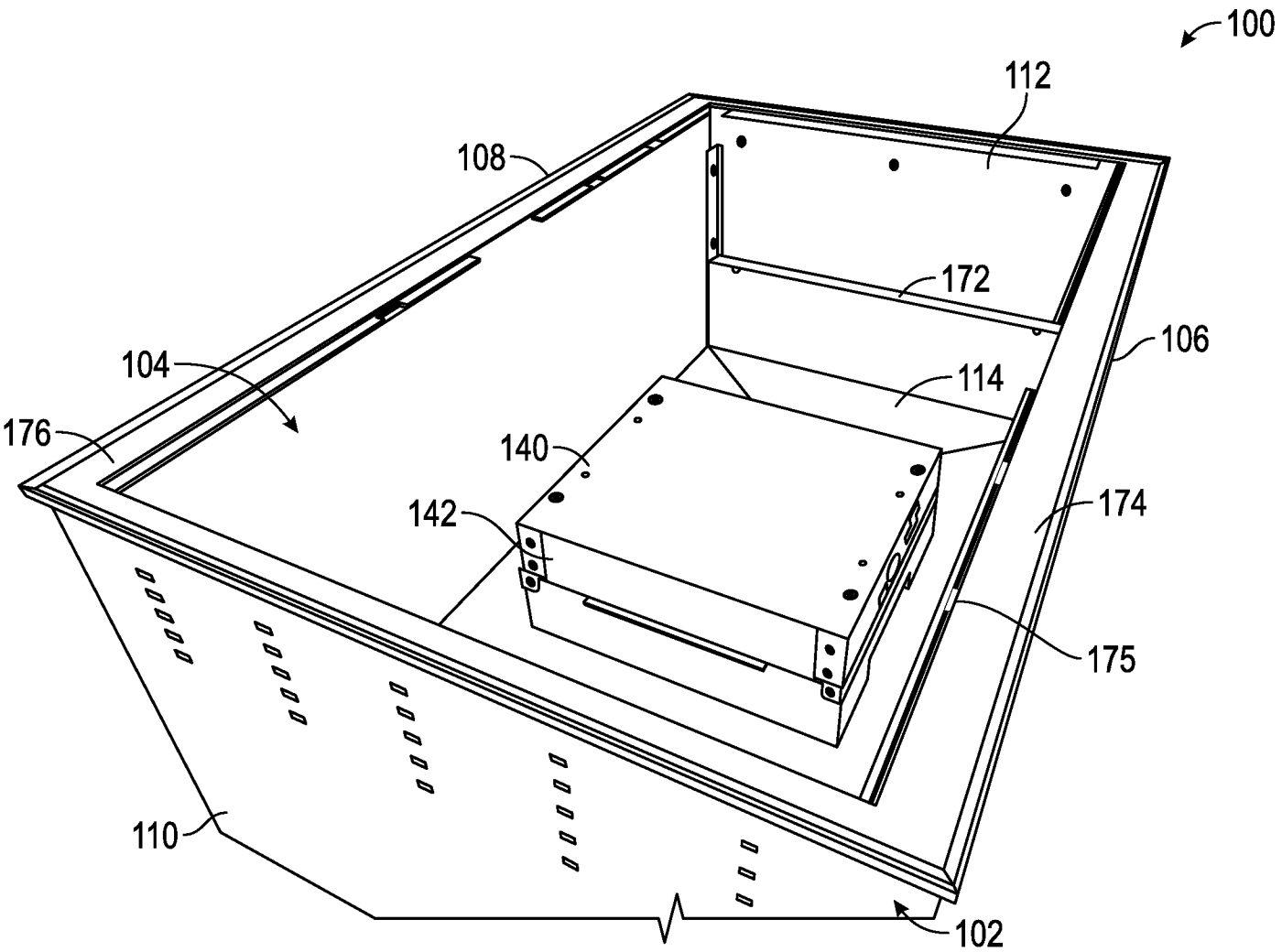
FIG. 6 is a fragmentary perspective view of a partially assembled cold food display unit of FIG. 1.
Figure 7:
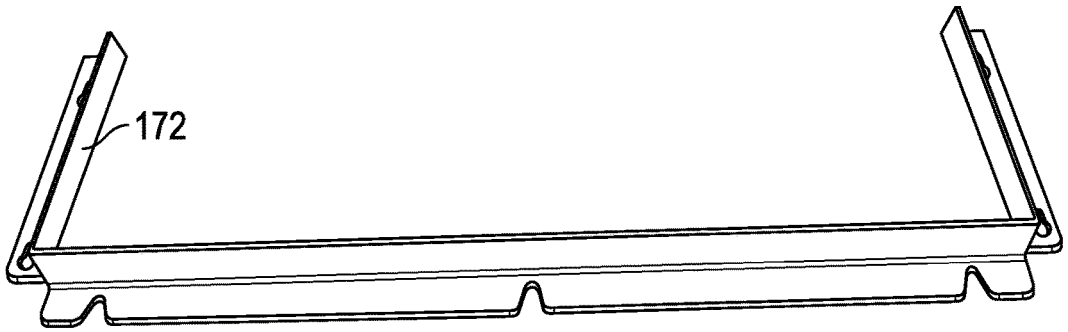
FIG. 7 is a perspective view of insert support brackets.

FIGS. 6-15 further illustrate cold food display unit 100. In particular, FIGS. 6-15 illustrate several steps of the assembly of cold food display unit 100. FIG. 6 illustrates cold food display unit 100 with insert 116 removed. Housing 140 containing evaporator 136 and fan 138 is positioned within receptacle 104 of well 102. An insert support bracket 172 (as shown in FIG. 7) is secured to each of sides 110 and 112 to provide a support for insert 116. Sides 106 and 108 include top portions 174 and 176 that each includes a series of slots 175.

Figure 8:
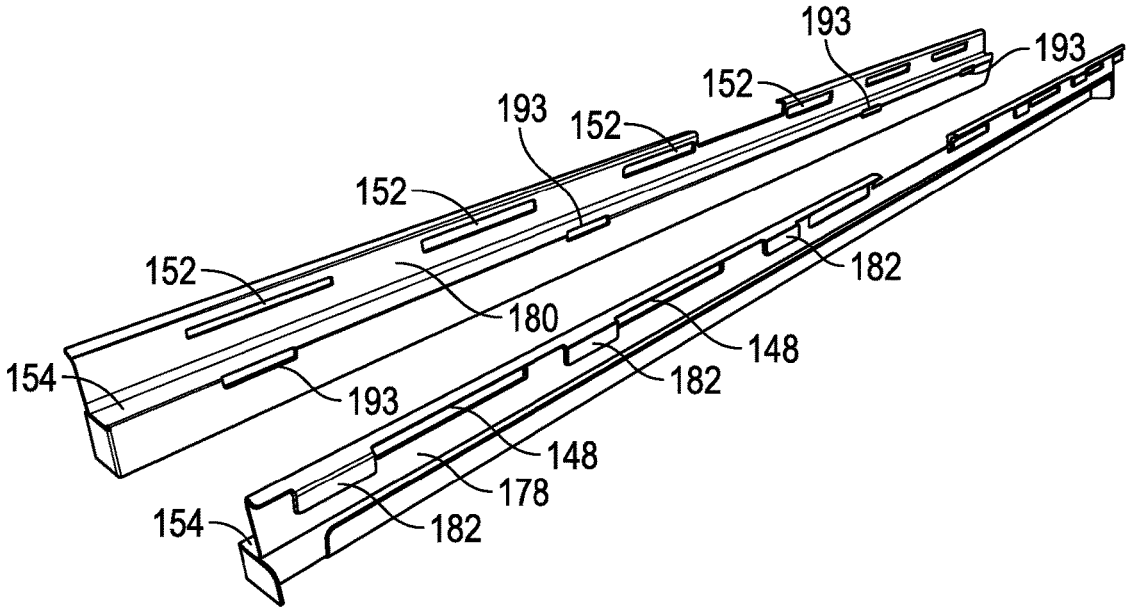
FIG. 8 is a perspective view of diverters.
Figure 9:
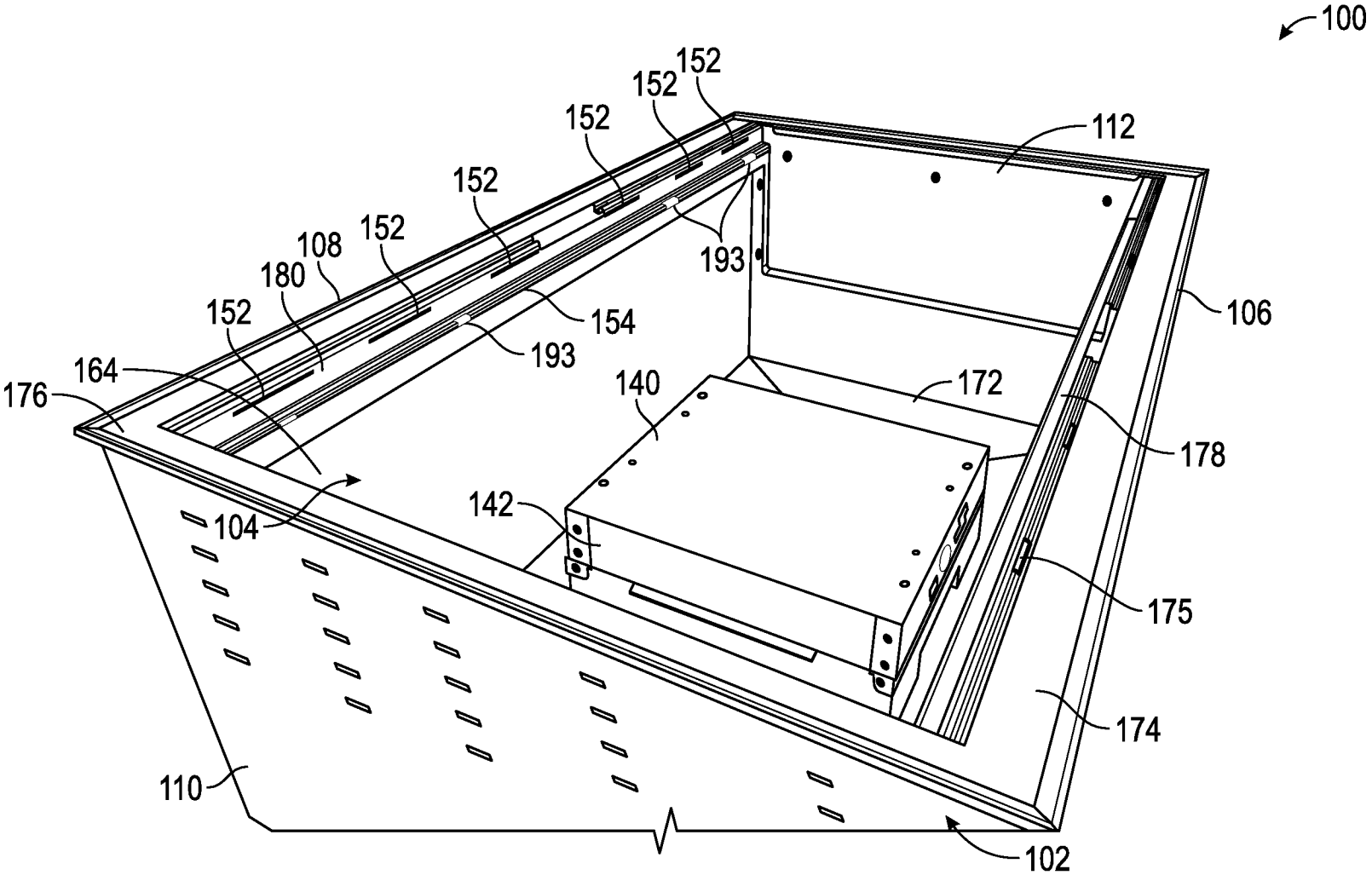
FIG. 9 is a fragmentary perspective view of a partially assembled cold food display unit of FIG. 1.

FIG. 8 illustrates diverters 178 and 180, which are components of insert 116. Each diverter 178 and 180 includes cooling air discharges 148 and 152, respectively. Each of the diverters 178 and 180 also includes a series of hooks 182 that correspond to the slots 175 formed in well 102 and serve to help attach diverters 178 and 180 to sides 106 and 108, respectively. Diverters 178 and 180 include ledge 154 for supporting one or more food pans 156. FIG. 9 illustrates diverters 178 attached to side 106 and illustrates diverter 180 attached to side 108.

Figure 10:
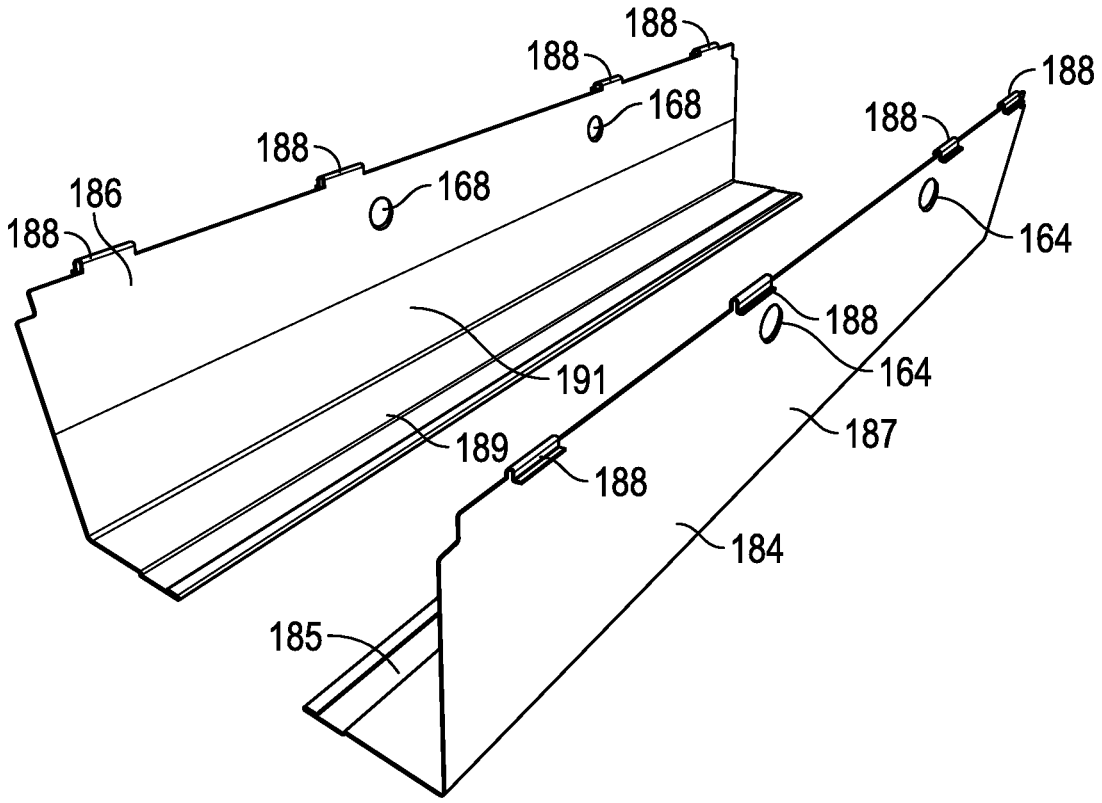
FIG. 10 is a perspective view of sides of the insert for the cold food display unit of FIG. 1.
Figure 11:
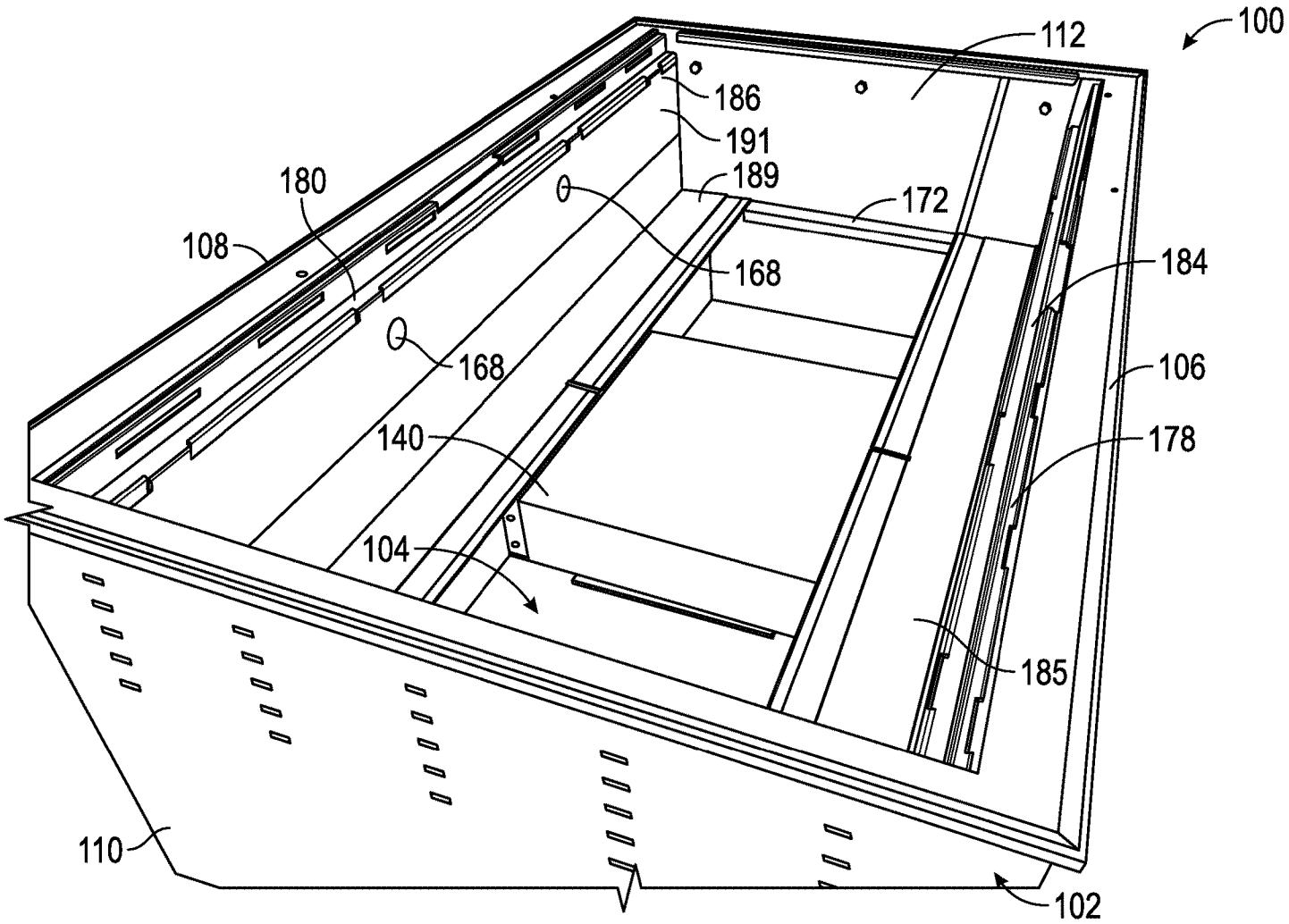
FIG. 11 is a fragmentary perspective view of a partially assembled cold food display unit of FIG. 1.

FIG. 10 illustrates sides 184 and 186, which are components of insert 116. Each side is substantially L-shaped. Side 184 includes horizontal portion 185 and vertical portion 187. Side 186 includes horizontal portion 189 and vertical portion 191. Both of the vertical portions include a series of hooks 188 for securing the sides to the diverters via corresponding slots 193 formed in the diverters 178, 180. FIG. 11 shows side 184 attached to diverter 178 and side 186 attach to diverter 180.

Figure 12:
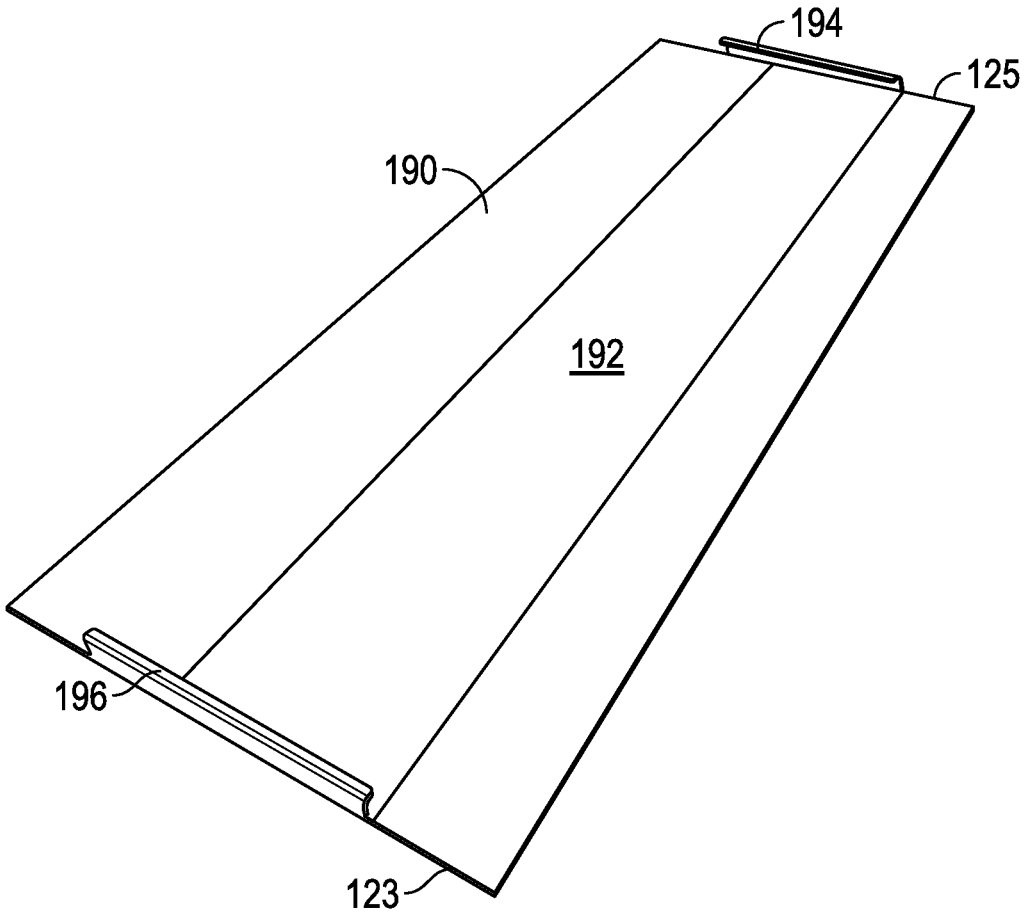
FIG. 12 is a perspective view of bottom of insert for the cold food display unit of FIG. 1.

FIG. 12 shows a bottom 190, which is a component of insert 116. Bottom 190 includes a substantially planar surface 192. Handles 194 and 196 are provided at opposite ends 123 and 125 of bottom 190. Handles 194 and 196 are included to ease assembly and disassembly of insert 116

Figure 13:
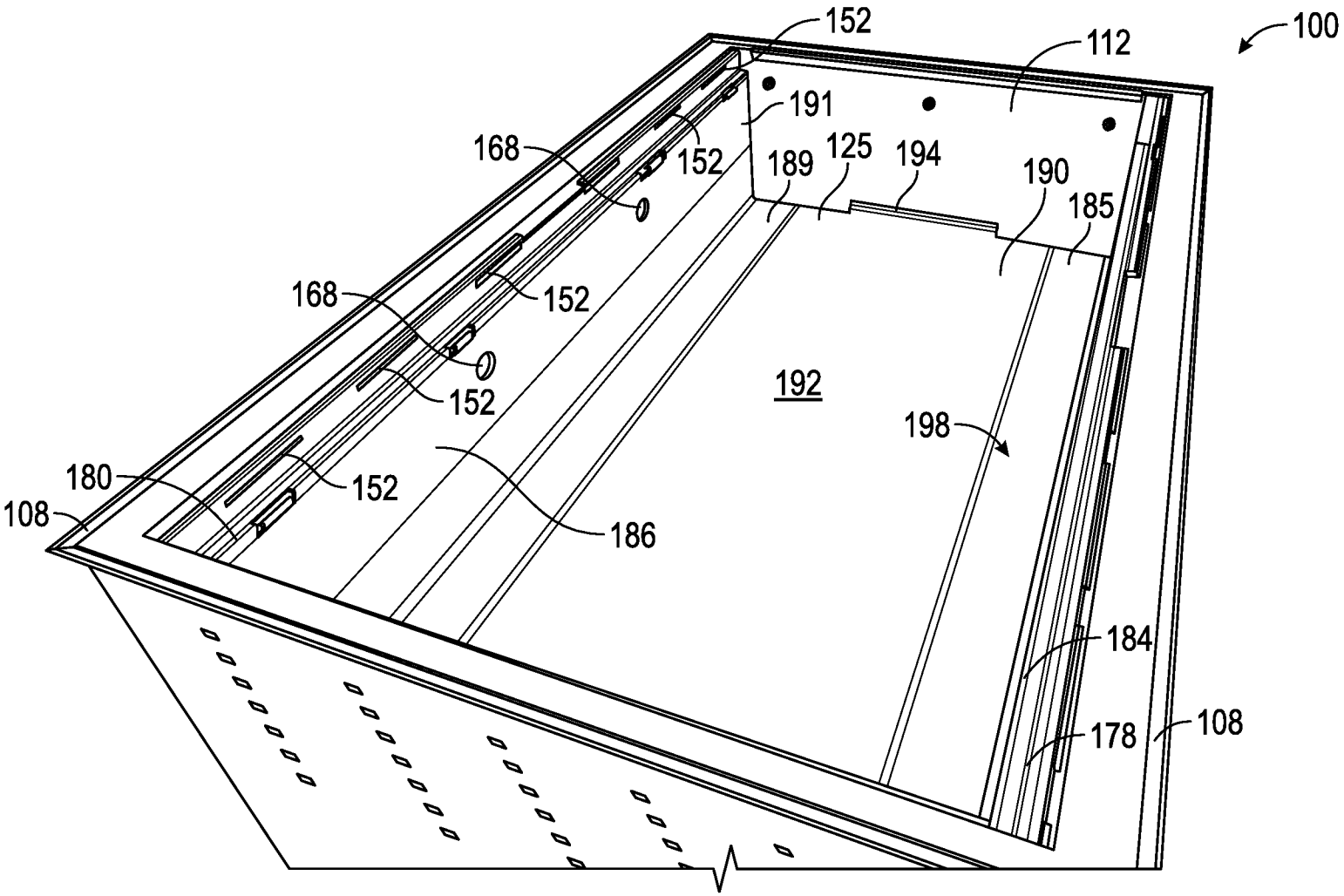
FIG. 13 is a fragmentary perspective view of the cold food display unit of FIG. 1.

(e.g., to allow a user to disassemble and clean cold food display unit 100). FIG. 13 illustrates bottom 190 attached to insert support brackets 172 and to horizontal portions of sides 184 and 186 thus completing assembly of insert 116 into well 102. Insert 116 may be secured to well 102 in other appropriate ways that differ from those described above. For example, various components of insert 116 could be welded, fastened or otherwise permanently or releasably attached to well 102. In some embodiments, the separate components of insert 116 (e.g., diverters, sides and bottom) could be combined into one or more integrally-formed components.

Figure 14:
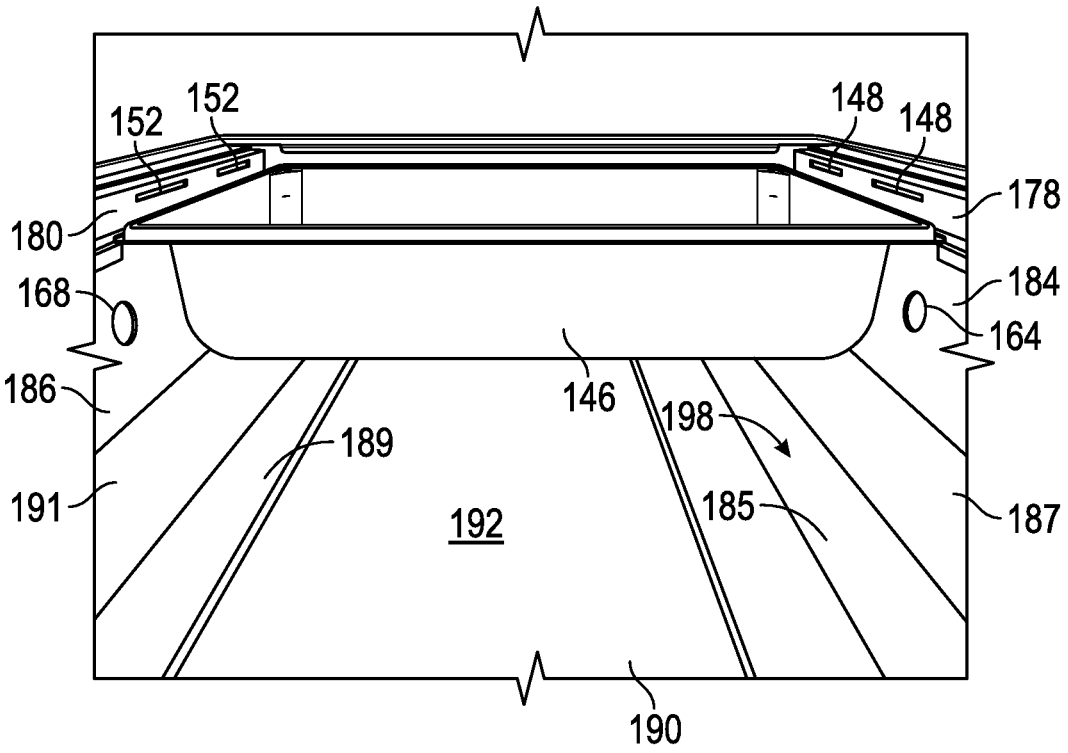
FIG. 14 is a section side view of the cold food display showing a food pan mounted therein.
Figure 15:
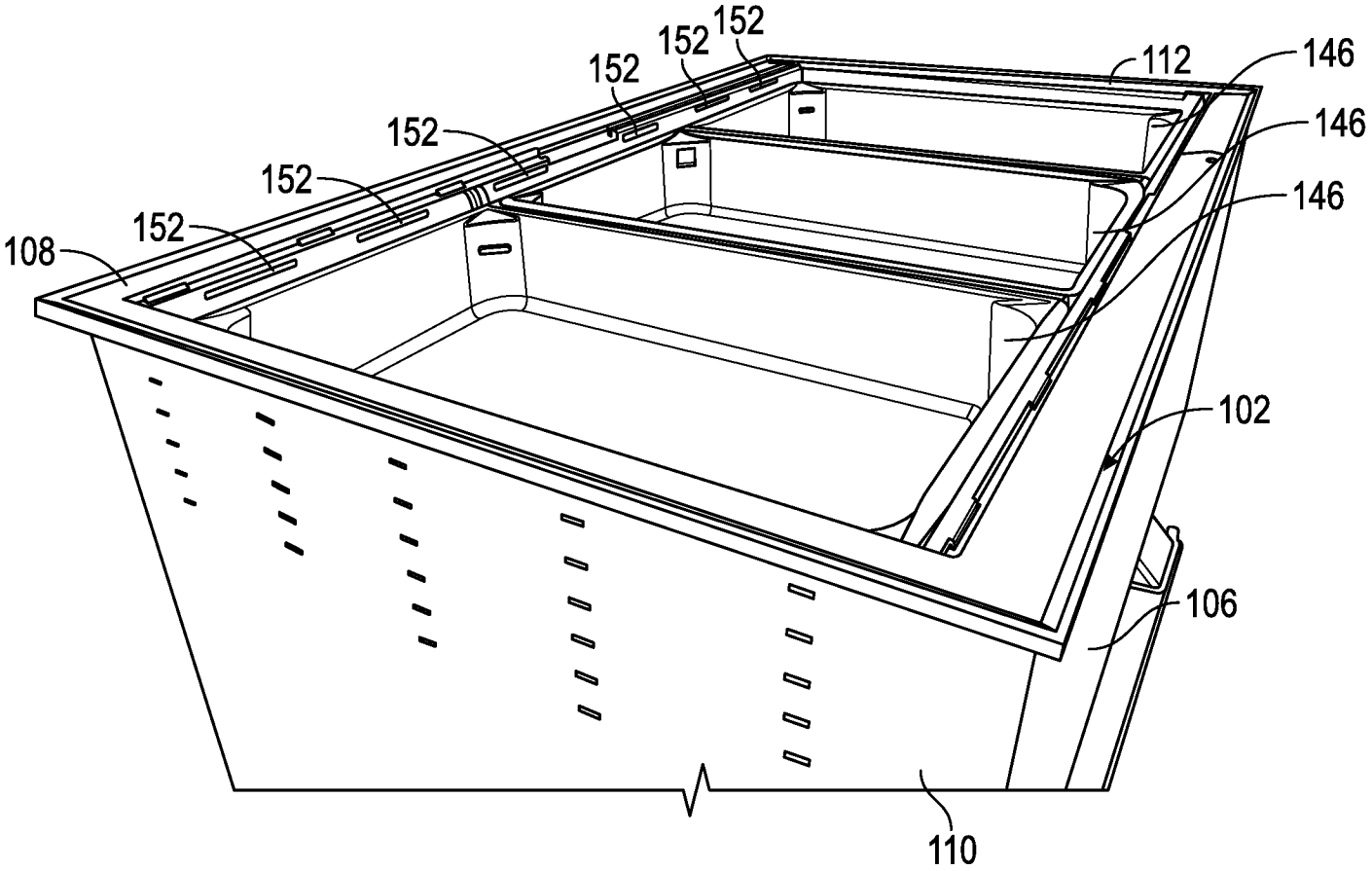
FIG. 15 is a perspective view of a cold food display unit with food pans mounted therein.

FIG. 14 illustrates a food pan 156 positioned within receptacle 198 formed above insert 116. As shown, cold air discharges 148 and 152 are located above food pan 156 and discharges 164 and 168 are located such that cooling streams exiting discharges 164 and 168 are directly at food pan 156. Food pan 156 is supported by ledge 154 formed in diverter 178 and the ledge 154 formed in diverter 180. FIG. 15 illustrates three food pans 156 inserted within well 102. The food pan 156 is cooled by the heat exchange from the chilled air exiting 152, and 168, and by the proximity of the chilled bottom 190 (which is cooled by the chilled/cooled air in the plenum 146 by the absorption of heat from the air space between the pan 156 and the insert 116 and/or the pan 156, which operates as a cold plate, heat sink, etc.).

Insert 116 may be sold separately from the rest of cold food display unit 100 to be used to retrofit conventional forced cold wells and provide the benefits associated with insert 116.

The construction and arrangement of the apparatus, systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, some elements shown as integrally formed may be constructed from multiple parts or elements, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

References herein to the positions of elements (e.g., "top," "bottom," "above," "below," etc.) are merely used to describe the orientation of various elements as illustrated in the Figures. It should be noted that the orientation of various elements may differ according to other exemplary embodiments, and that such variations are intended to be encompassed by the present disclosure.

"Fluidly coupled" locations or locations "in fluid communication" are connected such that a fluid (including air or other gas) is able to flow between locations.

What is claimed is:

1. A cold food display unit, comprising:

a well defining a receptacle, wherein the well includes a first side and a second side opposite the first side;

an insert positioned within the receptacle, wherein the insert includes a bottom, a first insert side, and a second insert side, wherein the first insert side extends away from the bottom from a first end of the bottom and the second insert side extends away from the bottom at a second end of the bottom opposite the first end, wherein the first insert side is spaced apart from the first side of the well to form a first cooling air flow path, and wherein the second insert side is spaced apart from the second side of the well to form a second cooling air flow path;

a refrigeration system including an evaporator positioned within a housing, wherein the housing is positioned within the receptacle below the bottom of the insert, wherein a cooling air outlet is formed in the housing, and wherein a fan is located within the housing and is configured to blow air across the evaporator, thereby providing cooling air at a positive static pressure to the first and second cooling air flow paths simultaneously via the cooling air outlet;

a first cooling air discharge fluidly coupled to the first cooling air flow path, wherein the first cooling air discharge is configured to discharge a first flow of cooling air toward the second side of the well;

a second cooling air discharge fluidly coupled to the second cooling air flow path, wherein the second cooling air discharge is configured to discharge a second flow of cooling air toward the first side of the well, and wherein the first cooling air discharge and the second cooling air discharge are configured to discharge the first flow of cooling air and the second flow of cooling air simultaneously;

a ledge configured to support one or more food pans, wherein the first cooling air discharge, the second cooling air discharge are located above the ledge; and an ambient air intake, wherein the ambient air intake is fluidly coupled to the housing of the refrigeration system to provide ambient air to be cooled by the evaporator.

2. The cold food display unit of claim 1, further comprising:

a first cooling air insert discharge formed in the first insert side and fluidly coupled to the first cooling air flow path, wherein the first cooling air insert discharge is configured to discharge a third flow of cooling air toward the second insert side; and a second cooling air insert discharge formed in the second insert side and fluidly coupled to the second cooling air flow path, wherein the second cooling air insert discharge is configured to discharge a fourth flow of cooling air toward the first insert side.

3. The cold food display unit of claim 2, further comprising:

wherein the first cooling air discharge and the second cooling air discharge are located above the ledge; and wherein the first cooling air insert discharge and the second cooling air insert discharge are located below the ledge.

4. The cold food display unit of claim 3, further comprising:

a food pan supported by the ledge so that the first flow of cooling air and the second flow of cooling air are discharged above the food pan and the third flow of cooling air and fourth flow of cooling air are discharged at the food pan.

5. The cold food display unit of claim 1, further comprising a plenum located between the cooling air outlet and the first and second cooling air flow paths, and wherein the refrigeration system provides cooling air to the plenum to chill the bottom of the insert and to generate a positive static pressure within the plenum and the first and second cooling air flow paths.

6. The cold food display unit of claim 5, wherein the insert includes a plurality of air discharge outlets, and wherein the static pressure within plenum and the first and second cooling air flow paths provide a substantially even distribution of cooling air to the plurality of air discharge outlets.

7. A cold food display unit, comprising:

a well defining a receptacle, wherein the well includes a first side and a second side opposite the first side;

an insert positioned within the receptacle to form a first cooling air flow path between the insert and the first side of the well and to form a second cooling air flow path between the insert and the second side of the well;

a refrigeration system including a cooling air outlet, wherein the cooling air outlet is positioned within the receptacle to simultaneously provide cooling air to the first and second cooling air flow paths;

a first cooling air discharge fluidly coupled to the first cooling air flow path, wherein the first cooling air discharge discharges a first flow of cooling air toward the second side of the well; and a second cooling air discharge fluidly coupled to the second cooling air flow path, wherein the second cooling air discharge discharges a second flow of cooling air toward the first side of the well, and wherein the first cooling air discharge and the second cooling air discharge are configured to discharge the first flow of cooling air and the second flow of cooling air simultaneously.

8. The cold food display unit of claim 7, wherein the insert includes a plenum located between the cooling air outlet and the first and second cooling air flow paths, and wherein the refrigeration system includes a fan for providing cooling air to the plenum to generate a positive static pressure within the plenum and the first and second cooling air flow paths.

9. The cold food display unit of claim 8, wherein the insert includes a plurality of air discharge outlets, and wherein the static pressure within plenum and the first and second cooling air flow paths provide a substantially even distribution of cooling air to the plurality of air discharge outlets.

10. The cold food display unit of claim 7, further comprising:

an ambient air intake, wherein the ambient air intake is fluidly coupled to the refrigeration system to provide ambient air to be cooled by the refrigeration system.

11. The cold food display unit of claim 10, further comprising:

a ledge configured to support one or more food pans.

12. The cold food display unit of claim 11, wherein the first cooling air discharge, the second cooling air discharge, and the ambient air intake are located above the ledge.

13. The cold food display unit of claim 11, wherein the ledge is formed in the insert.

14. The cold food display unit of claim 11, wherein the ledge is formed in the well.

15. The cold food display unit of claim 7, wherein the insert includes a bottom, a first insert side, and a second insert side, wherein the first insert side extends away from the bottom from a first end of the bottom and the second insert side extends away from the bottom at a second end of the bottom opposite the first end, wherein the first insert side is positioned near the first side of the well to form the first cooling air flow path, and wherein the second insert side is positioned near the second side of the well to form the second cooling air flow path.

16. The cold food display unit of claim 15, further comprising:

a first cooling air insert discharge formed in the first insert side and fluidly coupled to the first cooling air flow path, wherein the first cooling air insert discharge discharges a third flow of cooling air toward the second insert side; and a second cooling air insert discharge formed in the second insert side and fluidly coupled to the second cooling air flow path, wherein the second cooling air insert discharge discharges a fourth flow of cooling air toward the first insert side.

17. The cold food display unit of claim 16, further comprising:

a ledge configured to support one or more food pans;

wherein the first cooling air discharge and the second cooling air discharge are located above the ledge; and wherein the first cooling air insert discharge and the second cooling air insert discharge are located below the ledge.

18. The cold food display unit of claim 17, further comprising:

a food pan supported by the ledge so that the first flow of cooling air and the second flow of cooling air are discharged above the food pan and the third flow of cooling air and fourth flow of cooling air are discharged at the food pan.

19. The cold food display unit of claim 7, further comprising:

an internal air return intake positioned within the receptacle, wherein the internal air return intake is fluidly coupled to the refrigeration system to provide internal return air to be cooled by the refrigeration system.

20. The cold food display unit of claim 7, further comprising:

a ledge configured to support one or more food pans.

21. The cold food display unit of claim 20, wherein the ledge is formed in the insert.

22. The cold food display unit of claim 20, wherein the ledge is formed in the well.

23. A method of cooling a food pan;

supporting a food pan;

cooling air with a refrigeration system;

providing cooling air from the refrigeration system to a plenum at a positive static pressure, wherein the plenum is located below the food pan;

providing an insert between the plenum and the food pan to prevent the cooling air from flowing directly from the plenum to the food pan;

directing a first flow of cooling air from the plenum to a first cooling air discharge that discharges the first flow of cooling air in a first direction over the food pan; and directing a second flow of cooling air from the plenum to a second cooling air discharge that discharges the second flow of cooling air in a second direction over the food pan, wherein the second direction is opposite the first direction, and wherein the first cooling air discharge and the second cooling air discharge are configured to discharge the first flow of cooling air and the second flow of cooling air simultaneously.

* * * * *